US006532779B2

(12) United States Patent
Shen

(10) Patent No.: US 6,532,779 B2
(45) Date of Patent: Mar. 18, 2003

(54) LOCKSET ASSEMBLY ALLOWING INTERCHANGE BETWEEN AN INTERCHANGEABLE CORE TYPE HANDLE AND A CYLINDER TYPE HANDLE

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 09/881,522

(22) Filed: Jun. 14, 2001

(65) Prior Publication Data

US 2002/0189305 A1 Dec. 19, 2002

(51) Int. Cl.[7] ..... E05B 9/04

(52) U.S. Cl. ..... 70/224; 70/221; 70/222; 70/223; 70/367; 70/370; 70/371; 70/451; 292/336.3; 292/347; 292/DIG. 64

(58) Field of Search ..... 70/221, 222, 223, 70/224, 367, 370, 371, 451; 242/336.3, 347, DIG. 64

(56) References Cited

U.S. PATENT DOCUMENTS 5,233,851 A * 8/1993 Florian ..... 70/367
5,398,531 A * 3/1995 Shen ..... 292/348
5,564,296 A * 10/1996 Theriault et al. ..... 292/336.3
5,605,064 A * 2/1997 Katayama et al. ..... 292/336.3
5,752,399 A * 5/1998 Shen ..... 292/348
6,109,080 A * 8/2000 Chen et al. ..... 70/215

* cited by examiner

*Primary Examiner*—Anthony Knight
*Assistant Examiner*—Christopher Boswell
(74) *Attorney, Agent, or Firm*—Alan Kamrath; Rider, Bennett, Egan & Arundel, LLP

(57) ABSTRACT

A lockset assembly comprises an inner handle assembly, a chassis, a latch assembly, an outer spindle, an outer handle assembly of cylinder type, and an outer handle assembly of interchangeable core type. One of the outer handle assembly of cylinder type and the outer handle assembly of interchangeable core type is releasably engaged with the outer spindle to allow an interchange between a cylinder and an interchangeable core via an interchange between the outer handle assembly of cylinder type and the outer handle assembly of interchangeable core type without the need of replacement of a whole lockset.

4 Claims, 5 Drawing Sheets

LOCKSET ASSEMBLY ALLOWING INTERCHANGE BETWEEN AN INTERCHANGEABLE CORE TYPE HANDLE AND A CYLINDER TYPE HANDLE

BACKGROUND OF THE INVENTION

1. Field of the Invention

The present invention relates to a lockset assembly that allows interchange between an interchangeable core type handle and a cylinder type handle without replacing the whole lockset.

2. Description of the Related Art

FIG. 1 of the drawings illustrates a conventional cylinder type lockset comprising an inner handle assembly 7, a chassis 8, a latch assembly 80, an outer spindle 1, and an outer handle assembly. The outer spindle 1 includes a first slot 3 for engaging with an engaging rib 4 in a lever shank (not labeled) of an outer handle 2 of the outer handle assembly. A cylinder 62 is fitted in the outer handle 2. The cylinder 62 includes a wing 64 that extends beyond the outer spindle 1 via a second slot 6 in the outer spindle 1. The lever shank of the outer handle 2 is securely attached to the outer spindle to rotate therewith and includes a compartment defined by a wall means 72 for receiving the cylinder 62 and its wing 64. The compartment comprises a cylindrical portion 70 and a room 74 for receiving the wing 64. A fork-like insert 66 is inserted into the room 74 and includes a space 68 for securely holding the wing 64.

FIG. 2 of the drawings illustrates a conventional interchangeable core type lockset comprising an inner handle assembly 7, a chassis 8, a latch assembly 80, an outer spindle 10. and an outer handle assembly including an outer handle 9 with a lever shank 14. The outer spindle 10 includes a first slot 11 for engaging with an engaging rib 17 in the lever shank 14 of the outer handle assembly. A C-shape retainer ring 12 is attached to an outer end of the outer spindle 10. An interchangeable core 20 is removably mounted in a FIG. 8 hole 22 in the outer handle 9 and includes a lug 18 that bears against a stop 13 on the retainer ring 12, thereby preventing disengagement of the interchangeable core 20. A portion 16 of the interchangeable core 20 extends beyond the outer spindle 10 via a second slot 15 of the outer spindle 10. When replacement of the interchangeable core 20 is required, a proper key is inserted into the keyway 24 of the interchangeable core 20 and turned through a predetermined angle to retract the lug 18, thereby allowing removal of the interchangeable core 20 for replacement.

When a user intends to change the cylinder 62 to the interchangeable core 20 or vice versa, the whole lockset must be replaced, as the outer spindle 1 for the cylinder 62 is not suitable for the interchangeable core 20 due to the fact that the slot 6 of the outer spindle 1 is too small for the portion 16 of the interchangeable core 20.

The present invention is intended to provide an improved lockset assembly that mitigates and/or obviates the above problem.

SUMMARY OF THE INVENTION

It is the primary object of the present invention to provide an improved lockset assembly that allows interchange between an interchangeable core type handle and a cylinder type handle without replacing the whole lockset.

A lockset assembly in accordance with the present invention comprises an inner handle assembly, a chassis, a latch assembly, an outer spindle, an outer handle assembly of cylinder type, and an outer handle assembly of interchangeable core type. The outer handle assembly of cylinder type comprises a first handle and a cylinder mounted in the first handle. The outer handle assembly of interchangeable core type comprises a second handle and an interchangeable core mounted in the second handle.

One of the outer handle assembly of cylinder type and the outer handle assembly of interchangeable core type is releasably engaged with the outer spindle to allow an interchange between the cylinder and the interchangeable core via an interchange between the outer handle assembly of cylinder type and the outer handle assembly of interchangeable core type without the need of replacement of a whole lockset.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
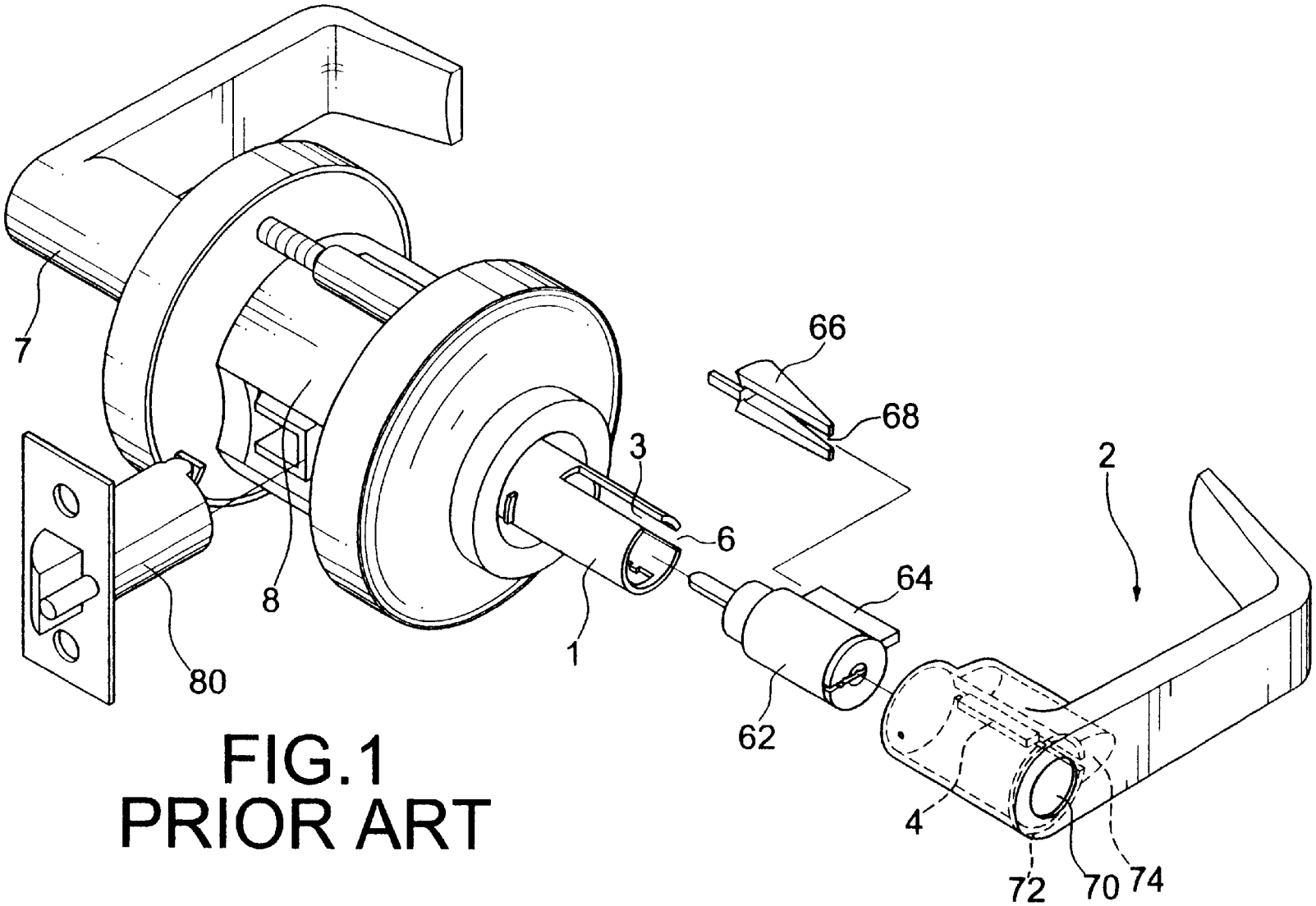
FIG. 1 PRIOR ART
FIG. 1 is an exploded perspective view of a conventional lockset with a cylinder.
Figure 2:
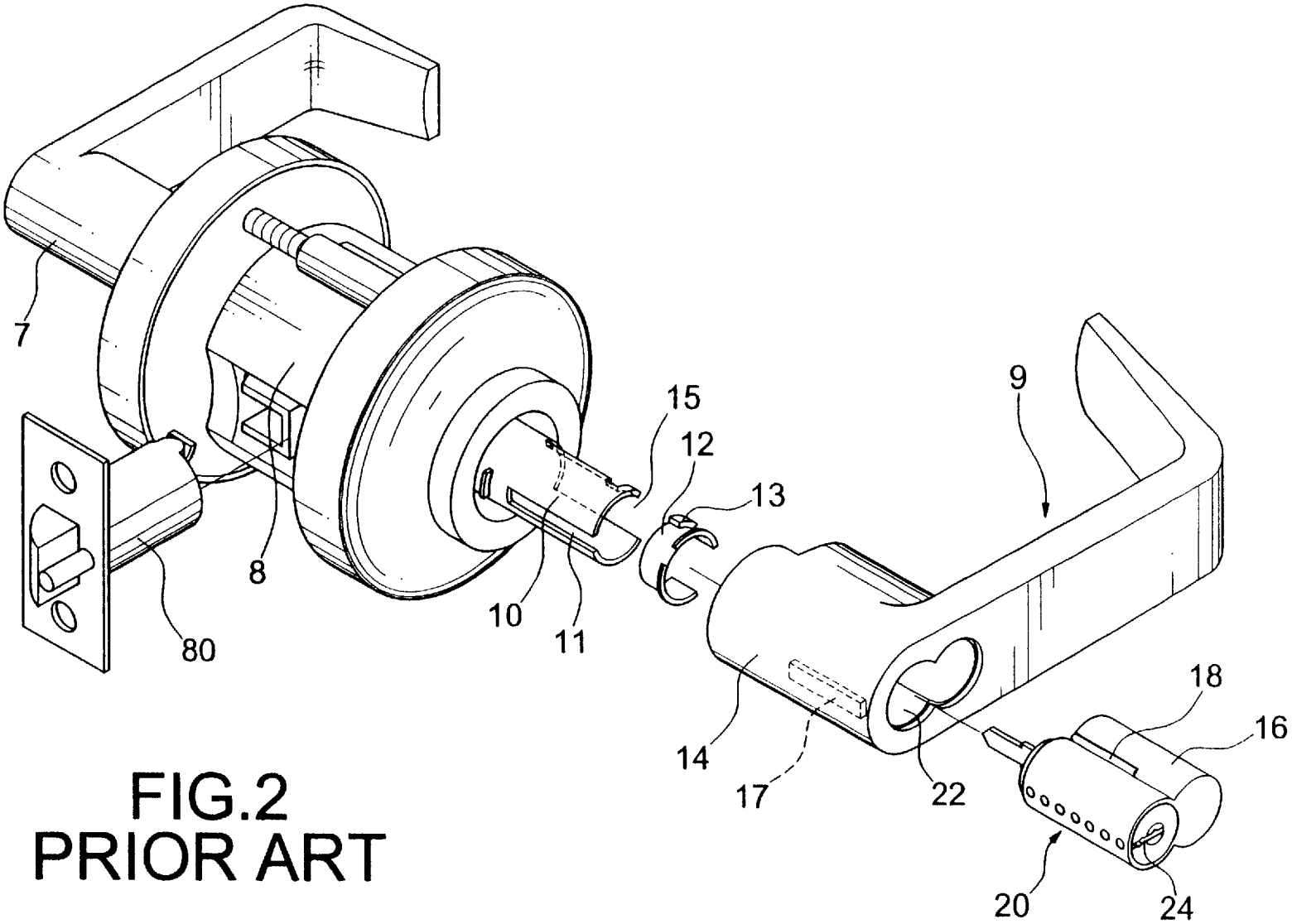
FIG.2 PRIOR ART
FIG. 2 is an exploded perspective view of a conventional lockset with an interchangeable core.

Referring to FIGS. 2 through 5, a lockset assembly in accordance with the present invention generally includes an inner handle assembly 7, a chassis 8, a latch assembly 80, an outer spindle 30, an outer handle assembly of cylinder type, and an outer handle assembly of interchangeable core type (FIG. 2). The user may choose one of the outer handle assembly of cylinder type and the outer handle assembly of interchangeable core type according to need.

The outer handle assembly of interchangeable core type comprises an outer handle 9 with a substantially figure 8 hole 22, an interchangeable core 20, and a retainer ring 13, which are identical to those shown in FIG. 2. An engaging rib 17 is formed on an inner periphery defining the figure 8 hole 22 for engaging with a first slot 11 in the outer spindle 10. A portion 16 of the interchangeable core 20 extends beyond the outer spindle 10 via a second slot 35 (FIG. 3) in the outer spindle 10. The outer handle assembly of interchangeable core type can be attached to the outer spindle 10 in a conventional manner.

Figure 3:
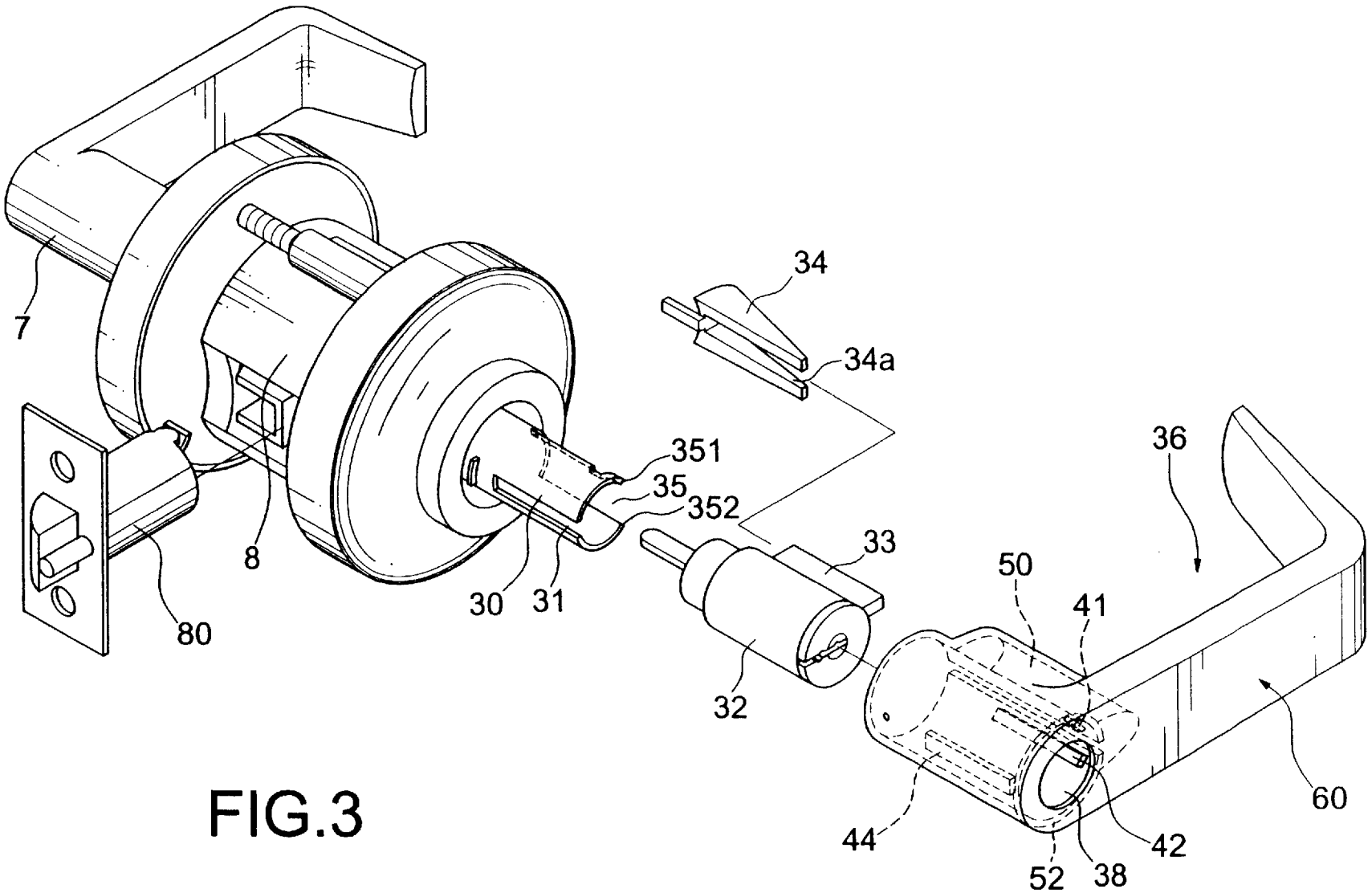
FIG. 3 is an exploded perspective view of a lockset assembly in accordance with the present invention.
Figure 4:
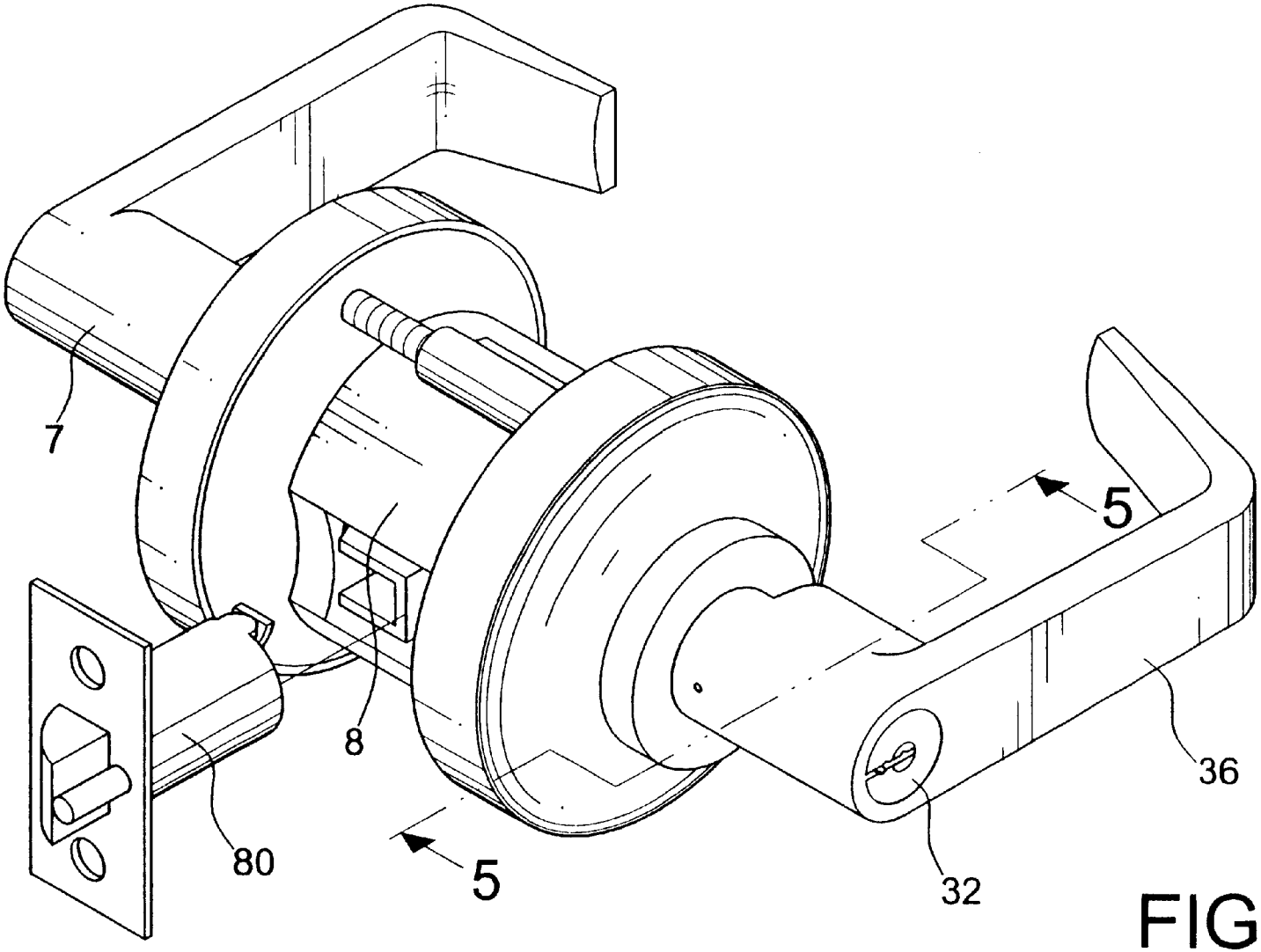
FIG. 4 is a perspective view, partly exploded, of the lockset assembly in accordance with the present invention.
Figure 5:
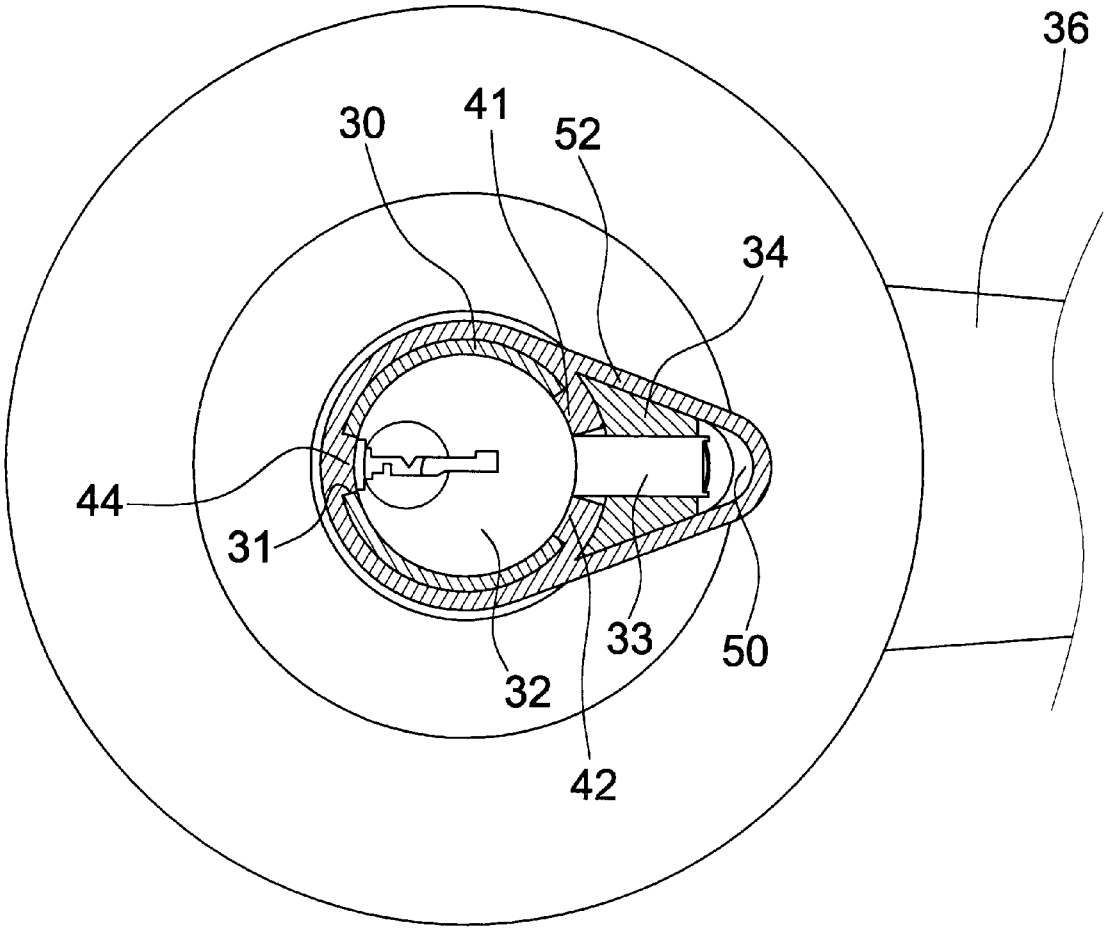
FIG. 5 is a sectional view taken along line 5—5 in FIG. 4.

Referring to FIG. 3, the outer handle assembly 60 of cylinder type comprises an outer handle 36 with a shank lever (not labeled) which has a compartment for securely receiving a cylinder 32. The cylinder 32 is fixed in the outer handle 36 and thus cannot be replaced. The cylinder 32 includes a wing 33 that extends beyond the outer spindle 30 via the second slot 35 in the outer spindle 30. The outer handle 36 is securely attached to the outer spindle 30 to rotate therewith and includes a compartment defined by a wall means 52 for receiving the cylinder 32 and its wing 33. An engaging rib 44 is formed on an inner periphery of the wall means 52 of the outer handle 36. The engaging rib 44 is securely engaged in a slot 31 in the outer spindle 30 to allow joint rotation of the outer spindle 30 and the outer handle 36. The compartment comprises a cylindrical first portion 38 and a second portion 50 for receiving the wing 33. A fork-like insert 34 is inserted into the second portion 50 and includes a space 34a for securely holding the wing 33. The outer handle assembly of cylinder type can be attached to the outer spindle 10 in a conventional manner. It is noted that the second slot 35 is too large for the wing 33 of the cylinder 32. A first insert 41 and a second insert 42 are formed on an inner periphery of the wall means 52 such that the first insert 41 is fitted between a side of the wing 33 and an end edge 351 delimiting a side of the second slot 35 and that the second insert 42 is fitted between the other side of the wing 33 and the other end edge 352 delimiting the other side of the second slot 35, thereby preventing undesirable movement of the cylinder 32.

By such an arrangement, the user may choose one of the outer handle assembly of cylinder type and the outer handle assembly of interchangeable core type according to need.

According to the above description, although all of the elements are conventional, the new combination and re-arrangement of the conventional elements are non-obvious and provide numerous advantages for manufacturers, sellers, and users. For manufacturers, only the common elements, the outer handle assembly of cylinder type, and the outer handle assembly of interchangeable core type are required to manufacture. The cost for stock and material is reduced largely. For sellers, the cost for stock is also largely reduced. For users, when changing a cylinder to an interchangeable core or vice versa, the users have only to replace the outer handle assembly of cylinder type with the outer handle assembly of interchangeable core type or vice versa without the need of replacing the whole lockset and without the aid of a locksmith.

Although the invention has been explained in relation to its preferred embodiment, it is to be understood that many other possible modifications and variations can be made without departing from the scope of the invention as hereinafter claimed.

What is claimed is:

1. A lockset assembly comprising:

an inner handle assembly;

a chassis;

a latch assembly;

an outer spindle;

an outer handle assembly of cylinder type, the outer handle assembly of cylinder type comprising a first handle and a cylinder mounted in the first handle; and an outer handle assembly of interchangeable core type, the outer handle assembly of interchangeable core type comprising a second handle and an interchangeable core mounted in the second handle;

wherein one of the outer handle assembly of cylinder type and the outer handle assembly of interchangeable core type is releasably engaged with the outer spindle to allow an interchange between the cylinder and the interchangeable core via an interchange between the outer handle assembly of cylinder type and the outer handle assembly of interchangeable core type without the need of replacement of a whole lockset;

the first handle of the outer handle assembly of cylinder type comprising a compartment, the cylinder comprising a wing projecting outward therefrom, the compartment being defined by a wall means for receiving the cylinder and the wing, the compartment comprising a cylindrical first portion for receiving the cylinder and a second portion for receiving the wing, the outer spindle further comprising a slot, the cylinder being mounted in the compartment with the wing extending beyond the outer spindle via the slot;

the wall means comprising a first insert and a second insert formed on an inner periphery thereof, the first insert being fitted between a side of the wing and an end edge delimiting a side of the slot of the outer spindle, the second insert being fitted between another side of the wing and another end edge delimiting another side of the slot of the outer spindle, thereby preventing undesirable movement of the cylinder.

2. The lockset assembly as claimed in claim 1, wherein the second handle of the outer handle assembly of interchangeable core type comprises an engaging rib and a FIG. 8 hole, further comprising a retainer ring attached to an outer end of the outer spindle, the retainer including a stop, the outer spindle comprising a first slot for engaging with the engaging rib of the second handle of the outer handle assembly of interchangeable core type, the outer spindle further comprising a second slot, the interchangeable core being removably mounted in the FIG. 8 hole and including a retractable member that bears against the stop on the retainer ring for preventing disengagement of the interchangeable core a portion of the interchangeable core extending beyond the outer spindle via the second slot.

3. The lockset assembly as claimed in claim 1, wherein the first handle of the outer handle, assembly of cylinder type comprises an engaging rib the outer spindle comprising another slot for engaging with the engaging rib of the first handle of the outer handle assembly of cylinder type.

4. The lockset assembly as claimed in claim 3, further comprising an insert mounted in the second portion of the compartment and including a space for securely holding the wing of the cylinder.

* * * * *